United States Patent [19]

Matsumiya et al.

[11] 4,340,621

[45] Jul. 20, 1982

[54] METHOD FOR PREVENTING FORMATION OF A HEAVY LIQUID LAYER ON A WEB AT A COATING START POSITION

[75] Inventors: Takeshi Matsumiya; Minoru Minoda, both of Minami-ashigara, Japan.

[73] Assignee: Fuji Photo Film Co., Ltd., Kanagawa, Japan

[21] Appl. No.: 125,054

[22] Filed: Feb. 27, 1980

[30] Foreign Application Priority Data

Mar. 6, 1979 [JP] Japan ..... 54-25749
Mar. 13, 1979 [JP] Japan ..... 54-28913

[51] Int. Cl.[3] ..... B05D 3/00; B05D 3/12

[52] U.S. Cl. ..... 427/294; 427/295; 427/296; 427/299; 427/322; 427/324; 427/326; 427/327; 427/350; 118/50

[58] Field of Search ..... 417/294, 295, 296, 322, 417/324, 326, 350, 299, 327; 118/50

[56] References Cited

U.S. PATENT DOCUMENTS 2,419,206 4/1947 Fisher ..... 427/326
3,916,043 10/1975 Fouble ..... 427/296 X
4,009,037 2/1977 Mannetal ..... 427/322 X

*Primary Examiner*—Michael R. Lusignan

*Attorney, Agent, or Firm*—Sughrue, Mion, Zinn, Macpeak & Seas

[57] ABSTRACT

A method for coating a web with a coating liquid wherein heavy coating of the web at the coating start position with the coating liquid is prevented. While a thin layer of pretreatment liquid having a low viscosity and consisting of water and/or organic solvent is applied at the coating start position and the region around the coating start position on the web, the web is fed into a coating section where the web is coated with the coating liquid with the coating liquid applied over the thin layer of pretreatment liquid on the web. With the coating operation carried out with a hopper-type coating device, a method is preferably employed in which the amount of pressure reduction of a bead stabilizing suction chamber is set at value higher than that used for steady-state operation. The coating liquid is applied onto the thin layer of pretreatment liquid on the web and thereafter the pressure reduction is returned to that normally used for steady-state operation to continue the coating operation with the coating liquid. In this dual-layer coating operation, heavy coating of the web at the coating start position with the coating liquid is prevented by cooperation of the expansive wetting effect of the thin layer of pretreatment liquid and the higher pressure reduction of the suction chamber.

8 Claims, 9 Drawing Figures

METHOD FOR PREVENTING FORMATION OF A HEAVY LIQUID LAYER ON A WEB AT A COATING START POSITION

BACKGROUND OF THE INVENTION

1. Field of the Invention

The present invention relates to a method of coating a flexible belt-shaped supporting element (hereinafter referred to as "a web" when applicable) which is continuously transported with suitable coating liquids in the manufacture of photographic films, photographic paper, instant film units, magnetic tapes, adhesive tapes, pressure-sensitive recording sheets, offset plates or the like. More particularly, the invention relates to a method for preventing a web from being heavily coated with a coating liquid at the coating start position on the web.

Such a web may be made of polyesters such as polyethylene terephthalate, polyethylene-2 and 6-naphthalate; polyolefins such a polypropylene; cellulose derivatives such as cellulosetriacetate and cellulosediacetate; plastic films of polycarbonate or the like; metallic sheets of Cu, Al, Zn, etc.; glass, porcelain and ceramic; or baryta paper and synthetic paper. According to the particular application of the method, a coating-liquid adhering base layer or back layer is provided on the web in advance. The total thickness of the web including such a layer is commonly of the order of 2 to 300$\mu$.

2. Description of the Prior Art

With reference to FIG. 1, in a conventional method of coating a web with a coating liquid or liquids, when the coating liquid 2 begins to contact the surface of the web 1 which is continuously moving in the direction of the arrow X in FIG. 1, the line connecting the initial contact points of the coating liquid 2 on the web 1 (hereinafter referred to as "a coating start position" when applicable) in general has a V-shaped, W-shaped or linear pattern, corresponding to FIGS. 1A, 1B and 1C, respectively, across the web 1 depending on the properties of the coating liquid, the type of the coating apparatus and the operating conditions of the coating apparatus. Furthermore, a heavy or thick coating portion 3 in which the amount of coating liquid increases over the desired value is formed across the web 1 by the coating liquid. The thickness of the heavy coating portion 3 may exceed by 50 to 500% the intended or regular thickness of a layer of coating liquid on the web. After the heavy coating portion 3 has terminated, a layer of coating liquid having the intended thickness is formed on the web as shown in FIG. 2.

A method for adequately preventing the formation of such a heavy coating portion 3 has not as yet been disclosed in the art. Heretofore a temporary countermeasure was employed in which the operating conditions of the apparatus were changed upon commencing the coating operation with the coating liquid 2 to reduce the drying load of the heavy coating portion 3 or to provide a sufficiently long drying time for the heavy coating portion thereby to prevent problems such as the wet film of coating liquid 2 sticking to the conveying guide means thereby making the film surface rough. To accomplish this, the following steps were performed.

1. The amount of coating liquid 2 supplied to the coating means was reduced to decrease the amount of coating liquid in the heavy coating portion 3.

2. The coating operation was started with the running speed of the web 1 set to a very low value after which the running speed was gradually increased to a desired value.

3. Operating conditions such as temperature, the volume of the air, and the velocity of the air in the drying device were changed for a certain period of time so that the heavy coating portion 3 could be completely dried and delivered from the drying zone.

Unfortunately, such methods are disadvantageous in that a coated film having a desired thickness and quality cannot be obtained without wasting a large amount of coating liquid.

A coating method eliminating this difficulty has been described in the specification of Japanese Laid-Open Patent No. 92328/1975. According to this method, a portion of the surface of the web 1 where the coating is to be started is roughened with a knurling tool or the like thereby to prevent the formation of the heavy coating portion.

According to this method, the heavy coating portion can be limited to about 11%. Thus, a satisfactory result can be obtained by increasing the drying capacity of the drying device by about 11%. Moreover, the number of defective articles can be greatly reduced.

However, the method is still advantageous in the following points. In using a web 1 whose surface has been roughened off the line, if the coating operation is suspended for some reasons and started again it is usually impossible to start the coating operation beginning with a particular roughened region of the web. Therefore, usually, it is necessary that a new web roll be loaded in the coating apparatus to start the coating operation beginning with a new roughened region of the new web.

If a roughened region is formed on the surface of the web on the line, then the above-described difficulty caused when the roughened region is formed off the line may be eliminated and, accordingly, the coating operation can be started beginning with any region of the web. However, in this case, it is necessary to deliver the web to the coating means without carrying along the fine dust or particles which were created while forming the roughened region. Otherwise the quality of the coated film surface would be considerably lowered by the particles and, accordingly, the number of defective articles would be increased. Therefore, it is necessary to set the running speed of the web 1 to a very low value to remove the particles from the roughened region of the web or a high performance dust remover must additionally be provided.

SUMMARY OF THE INVENTION

Accordingly, an object of this invention is to provide a coating method in which all of the difficulties accompanying a conventional coating method have been eliminated and which is simple in its operation and is safe to operate.

The foregoing object and other objects of the invention have been achieved by the provision of a method for coating a continuously moving web with a coating liquid in which, according to the invention, a thin layer of a pretreatment liquid having a low viscosity and consisting of water and/or organic solvent is applied onto the coating start position and the region around the coating start position. The web is then fed into a coating section where the web is coated with the coating liquid and thereafter the coating liquid is applied onto the thin layer of pretreatment liquid on the web which is being passed through the coating section whereby heavy coating of the web at the coating start position is prevented by the expansive wetting effect of the thin film of pretreatment liquid.

In the case where the coating operation is carried out with a hopper-type coating apparatus, the pressure reduction of the bead stabilizing suction chamber in the apparatus is set to a value higher than that for steady-state operation and thereafter returned to that for steady-state operation whereby heavy coating of the web at the coating start position with the coating liquid is prevented by cooperation of the expansive wetting effect of the thin layer pretreatment liquid on the web and the higher pressure reduction of the suction chamber.

The nature, principle and utility of the invention will become more apparent from the following detailed description when read in conjunction with the accompanying drawings.

DETAILED DESCRIPTION OF THE PREFERRED EMBODIMENTS

Figure 1A:
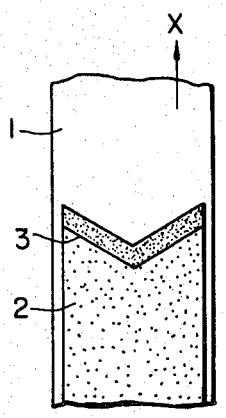
FIGS. 1A, 1B and 1C are explanatory diagrams showing various patterns of a heavy coating portion which may be formed at a coating start position according to a conventional coating method.
Figure 1B:
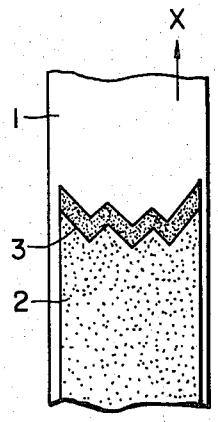
Figure 1C:
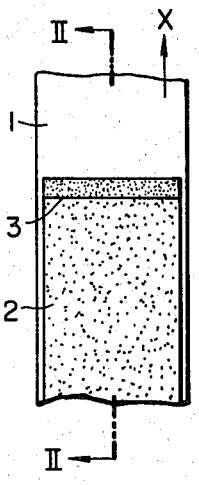
Figure 2:
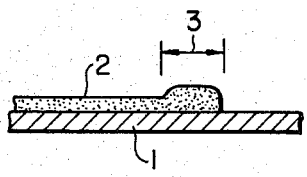
FIG. 2 is a sectional view taken along line II—II in FIG. 1C.
Figure 3:
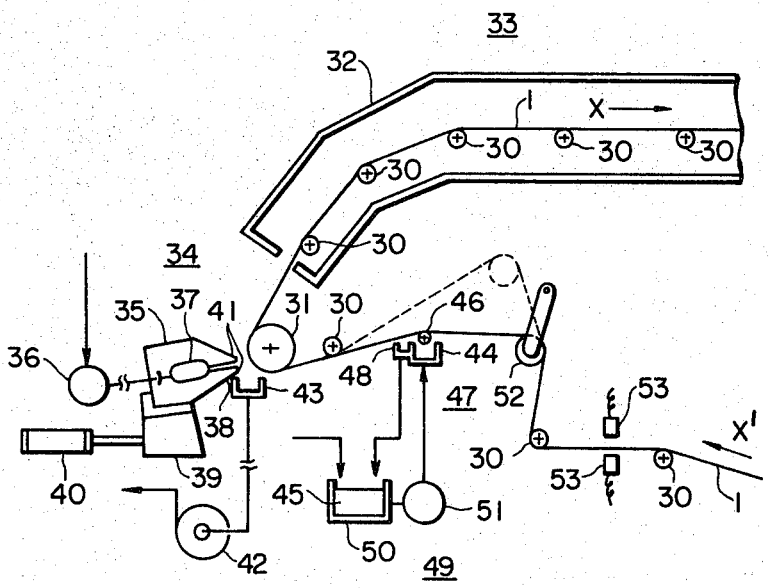
FIG. 3 is a side view showing the arrangement of an apparatus for practicing a coating method according to the present invention.

A preferred embodiment of the invention will be described with reference to FIGS. 3 through 7 in the accompanying drawings. FIG. 3 shows an apparatus for practicing a liquid coating method according to the invention. A web 1 is continuously conveyed in the direction of the arrow X' by a web feeding section, not shown, including a web joining device, not shown. The web 1, guided and supported by a number of guide rollers 30 suitably arranged, reaches a coating backing roller 31 whereupon the direction of movement of the web 1 is changed to the direction of the arrow X. The web 1 passes through a drying device 33 which includes a number of guide rollers 30 and a housing 32 which isolates the web from the external atmosphere after which the web is wound in a web winding section, now shown.

A coating section 34 confronts the coating backing roller 31. The coating section 34 includes an extrusion-type hopper 35 such as that disclosed by Japanese Patent Publication No. 12390/1970 or Japanese Laid-Open Patent 142643/1975. The extrusion-type hopper 35 is provided with a liquid delivery pump 36 adapted to uniformly deliver liquid. The pump 36 delivers a coating liquid 2 through piping into a pocket 37 in the hopper 35. The coating liquid 2 thus delivered exists as a flow of liquid having a uniform pressure distribution through a slit 38 which extends across the web 1. The liquid is extruded towards the surface of the web, the direction of advancement of which is changed by backing roller 31. The hopper 35 has a supporting stand 39 which is operated by an actuator 40. The actuator 40 is operated to set the clearance or gap between the surface of the web 1 and the edge 41, which forms the end portion of the aforementioned slit 38, to a predetermined value, so that the liquid 2 bridges between the edge 41 and the surface of the web 1. That is, the liquid 2 adheres to the surface of the web 1. A pressure decreasing blower 42 is operated to decrease the pressure in the space below the bridge of liquid which is defined by a suction chamber 43 thereby to stabilize the bead of coating liquid at the bridge.

As the web 1 moves, the coating liquid 2 forming the bead is carried away in the form of a thin film and the coating liquid 2 is continuously supplied by the pump 36. In this connection, a fundamental feature of the invention resides in that, before the above-described coating operation of the coating section 34 is carried out, a pretreatment section 49 provided upstream of the coating section 34, that is, in the web feeding section (not shown) side operates to apply a thin layer of pretreatment liquid 45 onto the surface of the web 1 to be coated with the coating liquid 2.

In order to more effectively achieve the objects of the invention, the following method may be employed in combination. First, the amount of pressure reduction of the bead stabilizing suction chamber 43 of the hopper-type coating section 34 is set to a value higher than that for steady-state operation. After being coated with the pretreatment liquid 45, that is, provided with a film 45' of pretreatment liquid 45, the web 1 moves to the coating section 34 where the aforementioned coating liquid is applied onto the coated film 45' of pretreatment liquid. Thereafter, the pressure of the suction chamber 43 is returned to the value for steady-state operation and the coating operation with the coating liquid 2 is continued.

The optimum composition of the pretreatment liquid 45 is determined in accordance with the material of the web 1, the properties of the coating liquid 2 and the movement speed of the web 1. However, the most important factors for determining the appropriate composition are that the coating liquid 2 should adhere to the surface of the web 1 with an expansive wet portion C (FIG. 6) in the coating section 34 and the pretreatment liquid should not overly increase the load of the drying device 33 in the following process.

In accordance with these requirements, the pretreatment liquid 45 includes additives such as water and/or organic solvent and, if necessary, a surface active agent. It is desirable that the pretreatment liquid be applied in the form of a thin film with the coating quantity being of the order of 3 to 30 $cc/m^2$. It is further desirable that the relative positions of the coating section 34 and the pretreatment section 49 and the point of exposure to the atmosphere are such that the pretreatment liquid is brought into contact with the coating liquid 2 before the wettability of the pretreatment liquid is lost by evaporation.

The pretreatment section 49 includes a rotatably supported bar 46 around which is wound a wire 0.1–0.5 mm in diameter, a coating plate 47 having a liquid receiving section 44 in which a larger part of the bar 46 is immersed, a liquid collecting section 48 which temporarily collects the pretreatment liquid 45 flowing over the liquid receiving section 44 and circulates it to a liquid receiving tank 50, and a liquid delivery pump 51 for supplying the pretreatment liquid 45 from the liquid receiving tank 50.

A dancer roller 52 is provided upstream of the bar 46 in such a manner that it is swingably displaceable. As the dancer roller 52 moves downwardly from the position indicated by the dotted line to the position indicated by the solid line, the bar 46 forms a contact angle which is appropriate for the coating operation for respect to the web 1. The bar 46 rotates in the direction of movement of the web 1.

The operation of the pretreatment section 49 thus organized will next be described in more detail. When coating is started at a given position on the web, the actuator 40 of the coating section 34 is displaced by a predetermined amount to set the clearance between the edge 41 forming the end portion of the slit 38 and the surface of the web 1 thereby forming a bridge of coating liquid 2 between the edge 41 and the surface of the web 1. In this operation, the dancer roller 52 forming the web passage indicated by the dotted line is swingably displaced to the position indicated by the solid line in response to a displacement start signal from the actuator 40 which may be provided, for instance, by operating a push-button switch.

Simultaneously, the pretreatment liquid 45 is circulated between the liquid receiving tank 50 and the coating plate 47 by the liquid delivery pump 51. The level of the pretreatment liquid 45 in the coating plate 47 is increased over the liquid overflow level of the coating plate 47 by the outer wall of the bar 46 which is automatically driven in the forward direction by the displacement start signal of the actuator. As a result, the pretreatment liquid is applied onto the surface of the web 1 which is in contact with the bar 46 at the predetermined contact angle. A part of the pretreatment liquid thus applied passes through a small clearance between the wire wound around the bar 46 and the surface of the web and is thus carried away with the web towards the coating section 34.

Figure 4:
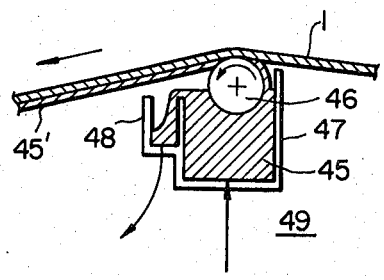
FIGS. 4 and 5 are enlarged sectional views showing the constructions of essential components of the apparatus in FIG. 3.
Figure 5:
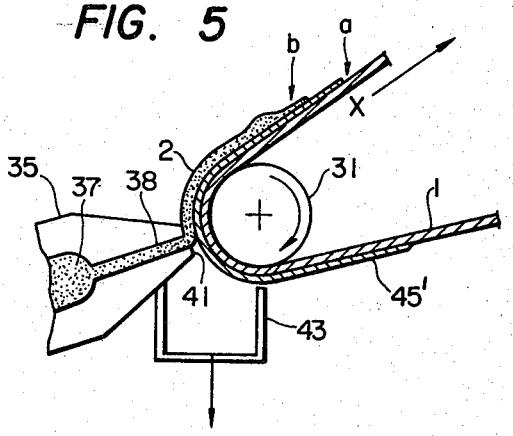

The viscosity of the pretreatment liquid 45 passing over the bar 46 is extremely low because its essential component is water or an organic solvent as described before. Therefore, excessive amounts of pretreatment liquid 45 adhering to the surface of the web 1 on the input side of the bar 46 are removed as is indicated in FIG. 4. A thin stripe pattern resembling the grooves on a phonograph record is formed by the scraping operation of the wire, then is made smooth by the pretreatment liquid 45 which has passed over the bar 46 and has adhered to the surface of the web. Thus, a uniform and thin layer of pretreatment liquid is continuously formed for a predetermined period of time.

The operation of the apparatus is so programmed that first the actuator 40 is displaced in response to the operation start signal to set the clearance between the edge 41 of the hopper and the surface of the web 1 to the predetermined value after which the pretreatment liquid coated film 45' is formed in response to the operation start signal of the actuator 40. When top end a of the coated film 45' passes the coating section 34, the coating liquid 2 can form the bead in the form of a bridge over the pretreatment liquid coated film 45' thus forming a double-layer film on the surface of the web 1.

If, in this operation, the amount of decrease of the pressure in the suction chamber 43 is set to a value higher than that used for steady-state operation, the coating liquid 2 will extend into a thin layer by the pressure reduction in the suction chamber 43 immediately before the coating liquid 2 bridges between the edge 41 of the hopper 35 and the surface of the coated film 45'. Therefore, the amount of coating liquid 2 which is carried away in the direction of movement of the web 1 from the bead B after it is deposited at the coating start position b is greatly reduced.

Figure 7:
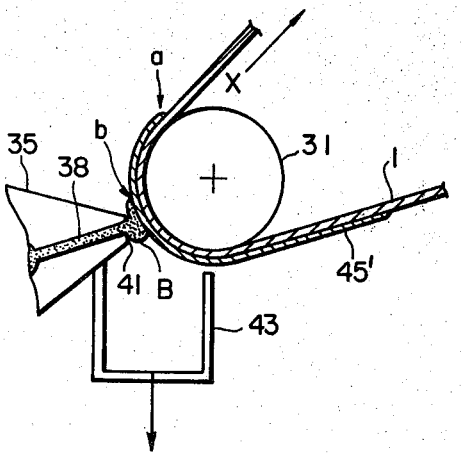

As is shown in FIG. 7, the bead B spreads upon the surface of the coated film 45' by the expansive wetting effect immediately after the coating liquid is applied onto the pretreatment liquid coated film 45' and the bead B is further drawn downwardly or towards the suction chamber 43 by the pressure reduction therein as a result of which the proportion of the bead B extending above the edge 41 of the hopper 35 is reduced. Furthermore, the coating liquid forming the bead B remaining below the edge 41 is sufficiently pulled away when passing near the edge and therefore the amount of coating liquid 2 which is carried away in the movement direction of the web 1 from the bead B after being deposited at the coating start position b is further reduced so as to thus form a double-layer film on the surface of the web 1.

Examples of organic solvents which may be used for the pretreatment liquid are ketones such as acetone, methylethylketone, methylisobutylketone, and cyclohexanone; alcohols such as methanol, ethanol, propanol and butanol; esters such as methyl acetate, ethyl acetate, butyl acetate, ethyl lactate and glycolmonoethylether acetate; glycolethers such as ether, glycoldimethylether, glycolmonoethylether and dioxane; tars (aromatic hydrocarbons) such as benzene, toluene, and xylene; and chlorinated hydrocarbons such as methylene chloride, ethylene chloride, carbon tetrachloride, chloroform, ethylenechlorohydrin and dichlorobenzene.

When the thin film of coating liquid 2 is continuously being formed and the bead of coating liquid 2 has been stabilized by the pressure reduction of the suction chamber 43, the dancer roller 52 is automatically swung back to the initial position and the web 1 is accordingly moved away from the bar 46. At this point, the coating operation using the pretreatment liquid 45 at the pretreatment section 49 has been finished. Succeedingly, the coating operation of the coating section 34 is carried out.

Figure 6:
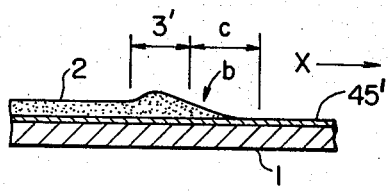
FIGS. 6 and 7 are sectional views showing heavy coating portions which are formed according to the coating method of the invention.

As shown in FIG. 6, the film of coating liquid 2 applied onto the pretreatment liquid film 45' forms the aforementioned expansive wet portion C in which the thickness is gradually reduced starting with the coating start position b. Following the coating start position b, the maximum thickness reaches about 150% (3') of the desired predetermined thickness in the case where the coating operation is carried out without adjusting the amount of decrease of the pressure in the suction chamber, while the maximum thickness peaks at about 130% of the predetermined desired thickness if the coating operation is carried out with the pressure reduction amount of the suction chamber suitably adjusted. Thereafter, the thickness of the film of coating liquid is set to the predetermined desired value. In the expansive wet portion C, the coating liquid 2 concentrates in the heavy coating portion 3 or 3' at the coating start position and is spread substantially instantly by the actions of the viscosity and surface tension of the pretreatment liquid coated film 45'.

In the above-described method according to the invention, the bar 46 may be replaced by the aforementioned extrusion type hopper 35, a fountain applicator, a gravure coater, or a sponge roll coater.

An extrusion-type hopper 35 is preferably employed in the coating section 34. However, the extrusion-type hopper may be replaced by a slide-type hopper or the like.

In the above-described embodiment, a series of automatic coating operations are carried out in response to the displacement of the actuator 40. However, if the coating start point on the surface of the web is marked with a vacuum-evaporated aluminum tape or black ink, then a series of coating operations can be automatically effected by detecting the presence of the mark with a mark detecting device 53 such as a contactless proximity sensor or an optical sensor. Furthermore, if desired or if it becomes necessary, the automatic coating operations may be carried out manually.

In the above-described fundamental method according to the invention, the pretreatment liquid 45 having a relatively low viscosity including water and/or organic solvent as the essential component is applied in the form of a thin layer on the surface of the web and thereafter the coating liquid 2 is applied to the web thus treated. The heavy coating portion 3 or 3' of the coating liquid layer 2 is spread by the low viscosity and surface tension of the pretreatment liquid coated film 45' whereby the thickness of the heavy coating portion 3 or 3' is limited resulting in the drying load of the drying device 33 not having to be greatly increased.

In the case where the technique is employed whereby, after the web is coated with the pretreatment liquid 45, the coating liquid 2 is applied upon the thin layer of pretreatment liquid 45 by the hopper 35 with the amount of pressure reduction being higher than that for steady-state operation, the heavy coating portion 3 or 3' of the coating liquid layer 2 is spread into a thin layer due to the low viscosity and low surface tension of the pretreatment liquid coated film 45' and by the spreading of the bead B which is caused by the reduced pressure. As a result, the thickness of the heavy coating portion 3 or 3' is limited to the extent that the drying load of the drying device 33 does not have to be greatly increased.

The meritorious effects of the method of the invention will be described in more detail with reference to actual examples.

EXAMPLE 1

A supporting element made of a polyethylene terephthalate film having a thickness of 100μ was transported at a speed of 30 m/min. The supporting element was coated with a pretreatment liquid and a coating liquid having the compositions specified below at intervals of 0.5 m by a pretreatment section 49 and a coating section 34 constructed as shown in FIG. 3 whereby a double-layer film was formed on the supporting element.

| Pretreatment Liquid Composition | |
|---|---|
| Acetone only<br>Amount of liquid: 17 cc/m$^2$ | |
| **Coating Liquid Composition** | **Parts by weight** |
| Acrylic acid copolymer | 19 |
| Acetone | 54 |
| Water | 27 |
| Viscosity: 580 cp<br>Amount of liquid: 130 g/m$^2$<br>Steady-state pressure reduction amount within suction chamber: −20 mm Aq | |

With the pressure reduction of the suction chamber maintained at −100 mm Aq before the coating operation was started and until one second had passed after the coating operation was started, the dual-layer coating operation was carried out under the same conditions as those described above.

Additionally, the web was coated only with the coating liquid by the coating section under the same conditions as those for the above-described dual-layer coating.

For the dual-layer coating operations, the increase in thickness of the heavy coating portions were 20% and 5%, respectively while for the single layer coating operation, the percentage was 190%.

EXAMPLE 2

A supporting element made of a polyethylene terephthalate film having a thickness of 100μ was transported at a speed of 30 m/min. The supporting element was coated with a pretreatment liquid and a coating liquid having the compositions specified below at intervals of 0.5 m. Extrusion-type hoppers were employed in both the pretreatment section and the coating section to form a dual-layer film on the supporting element.

| Petreatment Liquid Composition | Parts by weight |
|---|---|
| Water | 95 |
| Surface active agent (5 wt % solution) | 5 |
| Amount of liquid: 15 cc/m$^2$ | |
| **Coating Liquid Composition** | **Parts by weight** |
| Acrylic acid polymer | 7 |
| Water | 93 |
| Viscosity: 1500 cp<br>Amount of liquid: 143 g/m$^2$<br>Steady-state pressure reduction amount within suction suction chamber: −100 mm Aq | |

Furthermore, with the pressure reduction of the suction chamber maintained at −150 mm Aq before the coating operation was started and for 1.5 seconds after the coating operation was started, the dual-layer coating operation was carried out under the same conditions as those described above.

Additionally, the supporting element was coated with only the coating liquid by the coating section under the same conditions as those for the above-described dual-layer coating operations.

For the dual-layer coating operations, the percentage of increase in thickness were 50% and 30%, respectively. For the single-layer coating operation, the percentage increase was 200%.

EXAMPLE 3

A supporting element made of a polyethylene terephthalate film having a thickness of 100μ was transported at a speed of 30 m/min. A sponge roller of polyurethane was employed in the pretreatment section while an extrusion-type hopper was employed in the coating section. The supporting element was coated with a pretreatment liquid and a coating liquid having the compositions specified below at intervals of 0.5 m whereby a dual-layer film was formed on the supporting element.

| Pretreatment Liquid Composition | Parts by weight |
|---|---|
| Water | 95 |
| Surface active agent (5 wt % solution) | 5 |
| Amount of liquid: about 10 cc/m$^2$ | |
| **Coating Liquid Composition** | **Parts by weight** |
| Polyvinyl polymer | 8 |
| Water | 92 |
| Viscosity: 250 cp | |
| Amount of liquid: 100 g/m$^2$ | |
| Amount of steady-state pressure reduction: −150 mm Aq | |

Furthermore, with the pressure reduction of the suction chamber maintained at −200 mm Aq before the coating operation was started and for three seconds afterwards, the dual-layer coating operation was carried out under the same conditions as those for the above-described dual-layer coating operation.

Additionally, a single layer of coating liquid was formed on the supporting element by coating it with only the coating liquid by the coating section under the same conditions as those for the dual-layer coating operations.

The percentages of increase in thickness of the dual-layer coating operations were 21% and 12%, respectively. The corresponding percentage for the single layer coating operation was about 260%.

EXAMPLE 4

A supporting element made of a polyethylene terephthalate film having thickness of 127μ was transported at a speed of 30 m/min. The pretreatment section and the coating section were the same as those in Example 1. A dual-layer film was formed on the supporting element by coating it with a pretreatment liquid and a coating liquid having the following compositions at intervals of 0.5 m.

| |
|---|
| Pretreatment Liquid Composition |
| Water only |
| Amount of liquid: about 10 cc/m$^2$ |
| Coating Liquid Composition |
| First layer: Photosensitive silver halogenide emulsion (gelatin density 5 wt %) |
| Viscosity: 40 cp |
| Amount of liquid: 80 g/m$^2$ |
| Second layer: Gelatin potective layer (gelatin density 5 wt %) |
| Viscosity: 20 cp |
| Amount of liquid: 20 g/m$^2$ |
| Amount of steady-state pressure reduction: −15 mm Aq |

The first and second layers were formed simultaneously.

Furthermore, with the pressure reduction of the suction chamber maintained at −50 mm Aq before the coating operation was started and for two seconds thereafter, the dual-layer coating operation was carried out under the same conditions as those in the dual-layer coating operation of Example 1.

Additionally, the supporting element was coated with only the coating liquids under the same conditions as those in the above-described dual-layer coating operations.

The percentages of the increase in thickness for the heavy coating in the dual-layer coating operations in which the supporting element was coated with the pretreatment liquid and the coating liquids in stated order were about 50% and about 30%, respectively. The percentage of increase for the heavy coating in the coating operation in which the supporting element was coated with the coating liquids was 110%.

EXAMPLE 5

A supporting element made of a polyethylene terephthalate film having a thickness of 100μ was transported at a speed of 30 m/min. A pretreatment liquid and a coating liquid having the compositions specified below were applied to the supporting element at intervals of 0.5 m by the pretreatment section and the coating section.

| Pretreatment Liquid Composition | Parts by weight |
|---|---|
| Acetone | 10 |
| Ethanol | 24 |
| Water | 43 |
| Amount of liquid: 15 cc/m$^2$ | |
| **Coating Liquid Composition** | **Parts by weight** |
| N-containing cation polymer | 4 |
| Acetone | 12 |
| Ethanol | 30 |
| Water | 54 |
| Viscosity: 24 cp | |
| Amount of liquid: 80 cc/m$^2$ | |
| Amount of pressure reduction in the suction chamber: −20 mm Aq | |

Furthermore, with the pressure reduction of the suction chamber maintained at −50 mm Aq before the coating operation was started and for two seconds thereafter, the dual-layer coating operation was carried out under the same conditions as those in the above-described dual-layer coating operation.

Additionally, a single layer coating operation was carried out by applying the coating liquid onto only the supporting element under the same conditions as those for the above-described dual-layer coating operations.

The percentages of increase in the heavy coating portions in the dual-layer coating operations were 45% and 40%, respectively. The increase for the single layer coating operation was 400%.

EXAMPLE 6

A dual-layer coating operation was carried out by transporting a supporting element made of a polyethylene terephthalate film having a thickness of 100μ at a speed of 30 m/min and by applying a pretreatment liquid and a coating liquid having the following compositions onto the supporting element at intervals of 0.5 m.

| Pretreatment Liquid Composition | |
|---|---|
| Acetone only | |
| Amount of liquid: 12 cc/m$^2$ | |
| **Coating Liquid Composition** | **Parts by weight** |
| Acetylcellulose | 10 |
| Acetone | 60 |
| Cyclohexanone | 30 |
| Viscosity: 600 cp | |
| Amount of liquid: 124 cc/m$^2$ | |
| Amount of pressure reduction in the suction chamber: −15 mm Aq | |

Furthermore, with the amount pressure reduction in the suction chamber maintained at −60 mm Aq before the coating operation was started and for three seconds thereafter, a dual-layer coating operation was carried out under the same conditions as those for the above-described dual-layer coating operation.

Additionally, a single layer coating operation was carried out by applying the coating liquid onto only the supporting element under the same conditions as those for the above-described dual-layer coating operations.

The percentages of increase of the heavy coating portions in the dual-layer coating operations were 40% and 30%, respectively, while the percentage for the single layer coating operation was 350%.

In Examples 1 through 6, as the coating conditions, the clearance between the surface of the web and the edge of the hopper was set to an optimum value in the range of from about 100μ to 30μ so as to obtain the best conditions of the coated layer surface.

The heavy coating percentage was calculated according to the following equation:

Heavy coating percentage $$= \left( \frac{\text{heavy coating portion wet film thicknesss}}{\text{steady coating portion wet film thickness}} - 1 \right) \times 100$$

What is claimed is:

1. A method for applying a coating liquid onto a web being transported continuously by a coating section including coating means comprising the steps of:
   (a) applying a thin layer of pretreatment liquid having a low viscosity upon said web in the region of a coating-liquid coating start position;
   (b) transporting said web into said coating section;
   (c) applying said coating liquid upon said thin layer of pretreatment liquid on said web, while said thin layer of pretreatment liquid remains in a liquid phase, as said web passes through said coating section, such pretreatment liquid being selected such that heavy coating of said web at said coating start position with said coating liquid is prevented by an expansive wetting effect of said thin layer of pretreatment liquid; and
   (d) ceasing the application of said pretreatment liquid after the initial coating of said web with said coating liquid, while continuing to apply said coating liquid to said web.

2. The method as claimed in claim 1 in which said pretreatment liquid consists of water.

3. The method as claimed in claim 1 in which said pretreatment liquid consists of organic solvent.

4. The method as claimed in claim 3 in which said organic solvent is selected from the group consisting of ketones; alcohols; esters; glycolethers; aromatic hydrocarbons; and chlorinated hydrocarbons.

5. A method for applying a coating liquid on a web being transported continuously by a coating section having a hopper-type coating means including a bead stabilizing suction chamber comprising the steps of:
   (a) applying a thin layer of pretreatment liquid having a low in viscosity upon said web in the region of a coating-liquid coating start position;
   (b) transporting said web into said coating section;
   (c) applying said coating liquid upon said thin layer of pretreatment liquid on said web with a pressure in said suction chamber lower than that employed in steady-state operation; and
   (d) returning the pressure reduction of said suction chamber back to that appropriate for the steady-state operation to continue the coating operation with said coating liquid, said pretreatment liquid and said pressure being selected such that heavy coating of said web at said coating start position with said coating liquid is prevented by cooperation of an expansive wetting effect of said thin layer of pretreatment liquid and reduced pressure in said suction chamber.

6. The method as claimed in claim 5 in which said pretreatment liquid consists of water.

7. The method as claimed in claim 5 in which said pretreatment liquid consists of organic solvent.

8. The method as claimed in claim 7 in which said organic solvent is selected from the group consisting of ketones; alcohols; esters; glycolethers; aromatic hydrocarbons; and chlorinated hydrocarbons.

* * * * *